United States Patent [19]

Johnston

[11] Patent Number: 4,665,975

[45] Date of Patent: May 19, 1987

[54] PLATE TYPE HEAT EXCHANGER

[75] Inventor: Anthony M. Johnston, Hazelbrook, Australia

[73] Assignee: University of Sydney, Sydney, Australia

[21] Appl. No.: 753,660

[22] Filed: Jul. 10, 1985

[30] Foreign Application Priority Data

Jul. 25, 1984 [AU] Australia ..... PG6214

[51] Int. Cl.[4] ..... F28F 3/08; F28F 9/02

[52] U.S. Cl. ..... 165/167; 165/174

[58] Field of Search ..... 165/167, 174

[56] References Cited

U.S. PATENT DOCUMENTS

| | | | |
|---|---|---|---|
| 1,992,097 | 2/1935 | Seligman | 165/167 |
| 3,532,161 | 10/1970 | Lockel | 165/167 |
| 3,807,496 | 4/1974 | Stadmark | 165/167 |
| 4,182,411 | 1/1980 | Sumitomo et al. | 165/167 X |
| 4,347,896 | 9/1982 | Rosman et al. | 165/166 |

FOREIGN PATENT DOCUMENTS

| | | | |
|---|---|---|---|
| 2054817 | 2/1981 | United Kingdom | 165/167 |

*Primary Examiner*—Albert W. Davis, Jr.
*Assistant Examiner*—Richard R. Cole
*Attorney, Agent, or Firm*—Stefan J. Klauber

[57] ABSTRACT

A plate-type heat exchanger wherein a plurality of flat plates are stacked in face-to-face relationship and diffusion bonded together. The plates are formed within their respective thicknesses with channels forming heat-exchange zones through which fluid passes to exchange heat with fluid passing through channels in adjacent plates. Each of the channelled plates has an inlet port which communicates with one end of the heat-exchange zone, an outlet port which communicates with the other end of the heat-exchange zone and, located between the respective ports and the associated ends of the heat exchange zone, a smoothing zone and a distribution zone. The smoothing zone comprises transverse fluid-flow passages wherein a transverse-flow component is imparted to fluid flowing between the distribution zone and the heat-exchange zone, and the distribution-zone comprises a plurality of fluid-flow passages extending between the port and the smoothing zone. The distribution-zone passages have equal cross-sectional dimensions and a length and space relationship allowing substantially uniform flow of fluid at all points across the width of the heat exchange zone. Uniform flow of fluid is achieved by forming all distribution-zone passages to have the same length and be spaced apart by an equal amount at the smoothing zone, or by forming the distribution-zone passages with different lengths and varying the spacing between the passages at the smoothing zone wherein the spacing decreases with increasing length of the passages.

14 Claims, 9 Drawing Figures

PLATE TYPE HEAT EXCHANGER

FIELD OF THE INVENTION

This invention relates to plate type heat exchangers and, in particular, to a heat exchanger having plates which are patterned to provide for substantially uniform fluid flow distribution across the width of passages in a heat exchange zone.

BACKGROUND OF THE INVENTION

In plate type heat exchangers, fluids exchange heat whilst flowing through heat exchange zones between adjacent (stacked) peripherally sealed thin metal plates. These heat exchangers offer the attractions of true counter-current thermal contact, a large easily adjustable surface area-to-volume ratio, compactness and sparing use of expensive materials. Plate type heat exchangers are the most popular alternative to the more conventional shell-and-tube type heat exchangers for these reasons.

The most common plate type heat exchanger is the gasketed plate style in which the fluid delivery and return ports and the plate peripheries are sealed with a gasket. The thin metal plates are pressed to form the gasket locations, fluid distribution zones and corrugations which enhance heat transfer and which provide mechanical strength in the heat exchange zone. The plate stack is held together with heavy end plates which are mechanically supported by tie rods or a press. This style of heat exchanger offers the advantage of easy disassembly for cleaning, but it suffers from the drawbacks that the gaskets tend to limit the range of fluids and temperatures which can be handled, pressure containment is somewhat limited and a limited number of stock pressed metal plate designs must serve all duties. The desirability of eliminating elastomeric gaskets in some circumstances has led to the welded plate, spiral and lamella styles. However, these cannot be completely disassembled.

In the cyrogenics field a brazed aluminium plate-fin style of exchanger has been developed. Corrugated aluminium sheets (fins) and sealing bars are brazed to the flat plates which separate the fluids, with the delivery and return ports being attached to the plate edges where gaps are left in the sealing bars. This construction technique relies on brazing to provide thermal and mechanical bonds and so is limited to materials which can suitably be brazed and to the use of fluids and temperatures which are compatible with them.

The plate type heat exchanger to which the present invention relates differs from those mentioned above in the manner of plate production and assembly, and it offers the promise of cost savings in some applications. In the above described (prior art) heat exchangers, the fluid flow passages are formed by spacing apart the flat or pressed metal plates with gaskets or metal sealing bars. In the heat exchanger to which the present invention relates, the fluid flow passages are formed within the thickness of substantially flat plates. A heat exchanger having plates of the type to which the present invention relates is disclosed in Australian Patent Application No. 70211/81, filed May 4, 1981 in the name of University of Sydney.

In all plate type heat exchangers, provision should be made for even distribution of fluid across the full width of the heat exchange zone, since any tendency of fluids to adopt an uneven flow can be detrimental to performance. Some sort of distribution zone is generally required to connect a fluid inlet port to the heat exchange zone. This is because, due to practical requirements, the length of a port edge available to deliver fluid to the heat exchange zone is generally shorter than the width of the heat exchange zone itself and/or because the port edge is not wholely perpendicular to the direction of flow in the heat exchange zone. In each case the effective transverse extent of the port is less than the width of the heat exchange zone.

The above referenced patent application discloses heat exchange plates having a distribution zone in the form of a single channel which, through branch channels, connects the inlet and outlet ports of the device to a heat exchange zone.

SUMMARY OF THE INVENTION

In contrast, the present invention is directed to a plate-type heat exchanger having plates within which a distribution zone is formed to link an accessible edge of a fluid supply and/or discharge port to a heat exchange zone by way of a smoothing zone. The distribution zone within each plate is characterized in that it is composed of a plurality of separate fluid flow passages which are formed within the thickness of the plate, which have equal cross-sectional dimensions and which are arranged to provide for substantially uniform flow of fluid at points across the width of the heat exchange zone.

Thus, the present invention provides a heat exchanger comprising a plurality of substantially flat plates stacked in face-to-face relationship and bonded together. At least some of the plates are formed within their respective thicknesses with longitudinally extending channels which form heat exchange zones through which fluid can be passed to exchange heat with fluid passing through channels in adjacent plates. At least some of the plates which are formed with a said heat exchange zone are further formed with a first port communicating with one end of the heat exchange zone, a second port communicating with the other end of the heat exchange zone and, located between at least one of the ports and the associated end of the heat exchange zone, a distribution zone and a smoothing zone. The smoothing zone comprises one in which a transverse flow component is imparted to fluid flowing between the distribution zone and the heat exchange zone, and the distribution zone comprises a plurality of fluid flow passages extending between an accessible edge of the port and the smoothing zone. The distribution zone passages all are formed within the plate thickness, the passages all have equal cross-sectional dimensions and the passages have a length and space relationship which provides for substantially uniform flow of fluid at all points across the width of the heat exchange zone after it has passed through smoothing zone.

Uniform fluid flow at all points across the heat exchange zone preferably is achieved in one of two ways. Firstly, by arranging the distribution zone passages such that they all have the same length and are spaced from one another by an equal amount at the smoothing zone. Alternatively and most preferably, by arranging the distribution zone passages such that they have different lengths and such that the spacing between the passages at the smoothing zone reduces with increasing length of the passages.

The smoothing zone preferably comprises at least one tranverse fluid flow passage which extends between and links the heat exchange zone channels adjacent the ends thereof.

Separate distribution/smoothing zones would normally be provided at each end of the heat exchange zone, one communicating with an accessible edge of the first (inlet) port and the other communicating with an accessible edge of the second (outlet) port. However, when sufficient space is available in the plates to accommodate an inlet port which has the same width as the heat exchange zone, the plates may be constructed in a manner such that the passages of the heat exchange zone communicate directly with the inlet port, and no need would exist then for a distribution zone at the inlet side of the heat exchange zone. Similarly, if sufficient space exists to accommodate an outlet port which has the same width as the heat exchange zone, no need will exist for a distribution zone at the outlet end of the heat exchange zone. However, the invention is premised on the assumption that a distribution zone will be required at one or the other or both ends of the heat exchange zone.

The heat exchanger is normally constructed so that heat exchange regions in alternate plates carry different fluid streams. In the simplest arrangement, a major portion of one surface of each plate is formed with channels (apart from port apertures), and all fluid passages in the heat exchange, distribution and the smoothing zones of the heat exchanger are positioned to confront a plain, unchannelled surface of the abutting plate. However, many alternative arrangements are possible. For example:

(a) Both sides of a plate may have channels and passages formed in the surfaces of the plate.

(b) The channels may be formed as slits in the plates, and extend through the full thickness of such plates. Successive slitted plates or groups of such plates will need to be separated from adjacent plates or groups of plates by partitioning plates in order to prevent mixing of the fluid streams. Such partitioning plates will incorporate appropriate port apertures.

The present invention also provides a plate for use in a heat exchanger as hereinbefore defined. Such plate is formed within its thickness with longitudinally extending channels which constitute a heat exchange zone through which fluid can be passed. Additionally, the plate is formed with a first port which communicates with one end of the heat exchange zone, with a second port which communicates with the other end of the heat exchange zone, and, located between at least one of the ports and the associated end of the heat exchange zone, with a distribution zone and a smoothing zone. The smoothing zone comprises one in which a transverse flow component is imparted to fluid flowing between the distribution zone and the heat exchange zone, and the distribution zone comprises a plurality of fluid flow channels which extend between an accessible edge of the port and the smoothing zone. The distribution zone passages are formed within the plate thickness, the passages all have equal cross-sectional dimensions, and the passages have a length and space relationship which provides for substantially uniform flow of fluid at all points across the width of the heat exchange zone after it has passed through the smoothing zone.

The fluid flow channels and passages within the plates may be formed by punching, electro-discharge machining, erosion, milling, grinding, vaporisation, burning, coining, or other known methods. However, the metal preferably is removed by a process of chemical or electrochemical machining, wherein the unremoved metal is protected by a mask which is printed, screen-printed or photographically applied (using a photo-resist) on the metal plate prior to exposure to the machining medium. This latter technique provides an inexpensive and rapid means of tooling for new and unusual designs, allowing the heat exchanger to be closely tailored to the required duty at a relatively low cost.

A wide variety of metals can be chemically machined, and so the plate production technique is not limited to materials which can be pressed. The common materials of heat exchanger construction, i.e., steel, stainless steel, brass, copper, bronze, aluminium and titanium may be employed.

Where the fluid inlet and outlet ports are formed within the periphery of the plates, the geometry of the ports is usually sufficiently simple to be conveniently punched. Also, the geometry of the plate periphery is usually sufficiently simple as to be guillotined. Where greater complexity is required in either case, chemical milling or some other technique, such as those already mentioned, may be employed.

The stacked plates of the heat exchanger may be held in face-to-face relationship by any one of a number of techniques. Grooves may be formed in the plates, in the same manner as the fluid passages, to accept gaskets and the plate stack may be clamped together in the same manner as a conventional gasketed-plate heat exchanger. Gaskets may be omitted in some circumstances, with reliance for sealing being then placed on flat surface-to- surface contact. Such techniques would allow for disassembly for cleaning. Alternatively, the plates may be welded, soldered, brazed or adhered together over suitable areas of their surface to eliminate problems with gaskets and to obviate the need for supporting end plates. Preferably, the plates are diffusion bonded together.

The invention will be more fully understood from the following description of preferred embodiments of the heat exchanger and a number of exemplary plates which may be employed in construction of the heat exchanger. The description is provided with reference to the accompanying drawings.

DETAILED DESCRIPTION OF THE INVENTION

Figures 1, 1A:
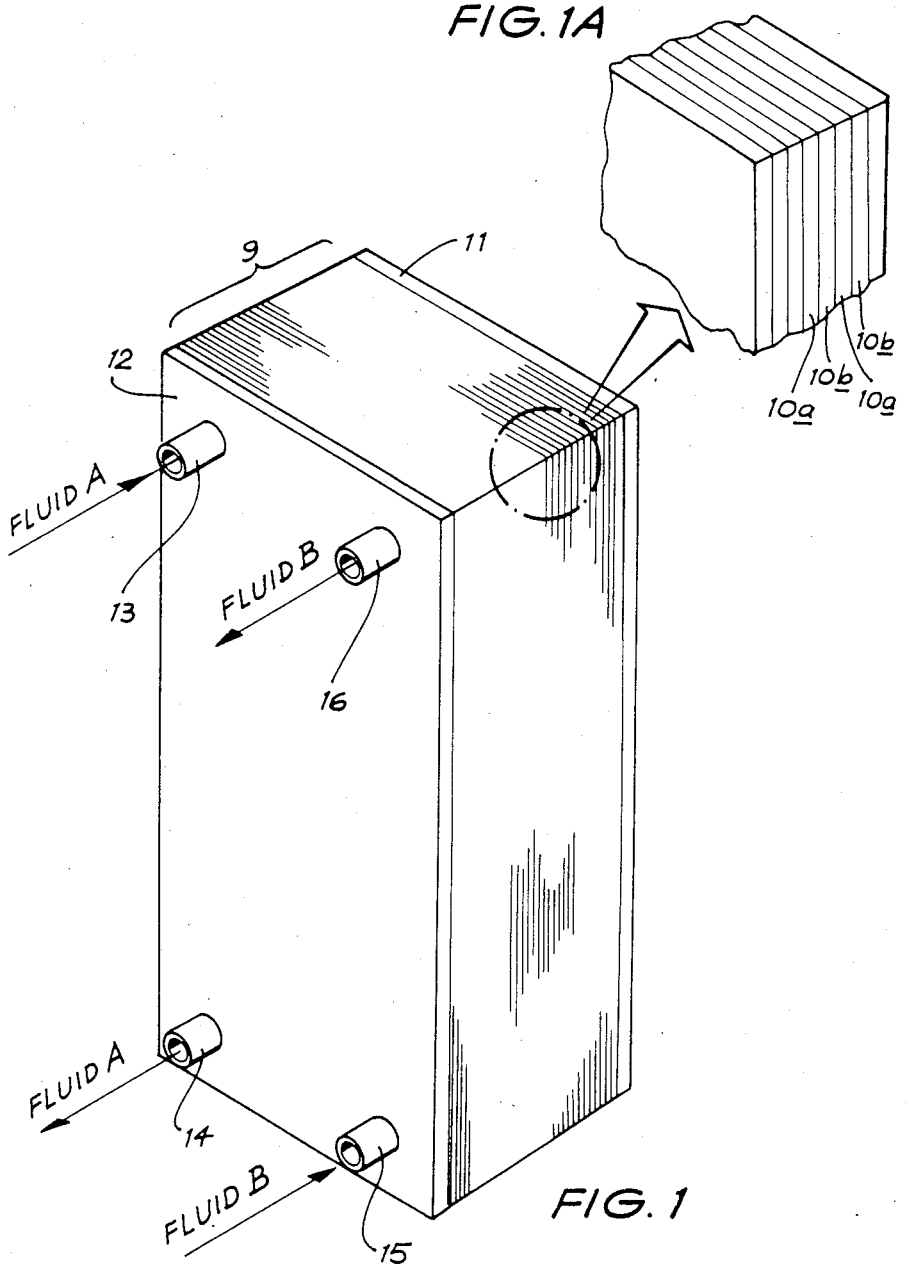
FIG. 1 shows a perspective view of a first heat exchanger incorporating a plurality of metal plates of the types shown in, for example, FIG. 5 or FIG. 6.
FIG. 1A shows on an enlarged scale a portion of the heat exchanger illustrated in FIG. 1.

As shown in FIG. 1, the heat exchanger comprises a stack 9 of metal plates 10 which are diffusion bonded or otherwise affixed (e.g., by clamping) in face-to-face relationship. The stack of plates is located between end plates 11 and 12 and, here again, the end plates may be bonded or clamped to the stack of plates that they sandwich.

The end plate 11 comprises a planar blanking plate but the end plate 12 includes four ports 13 to 16 to which fluid lines (not shown) may be connected. The ports are aligned with those which are provided in the stack of plates 10, for example with those shown in the plate of FIG. 5 of the drawings. A first fluid (A) is delivered to port 13 and exhausted from port 14. In passing through the stack of plates of the heat exchanger it is divided into parallel streams which pass through one set of parallel heat exchange networks. A second fluid (B) is delivered to port 15 and exhausted from port 16. It is similarly divided into parallel streams which pass through a second set of parallel heat exchange networks interleaved with the first set. Heat is exchanged between fluids A and B as a result of countercurrent thermal contact between the fluids in the heat exchanger.

Figure 5:
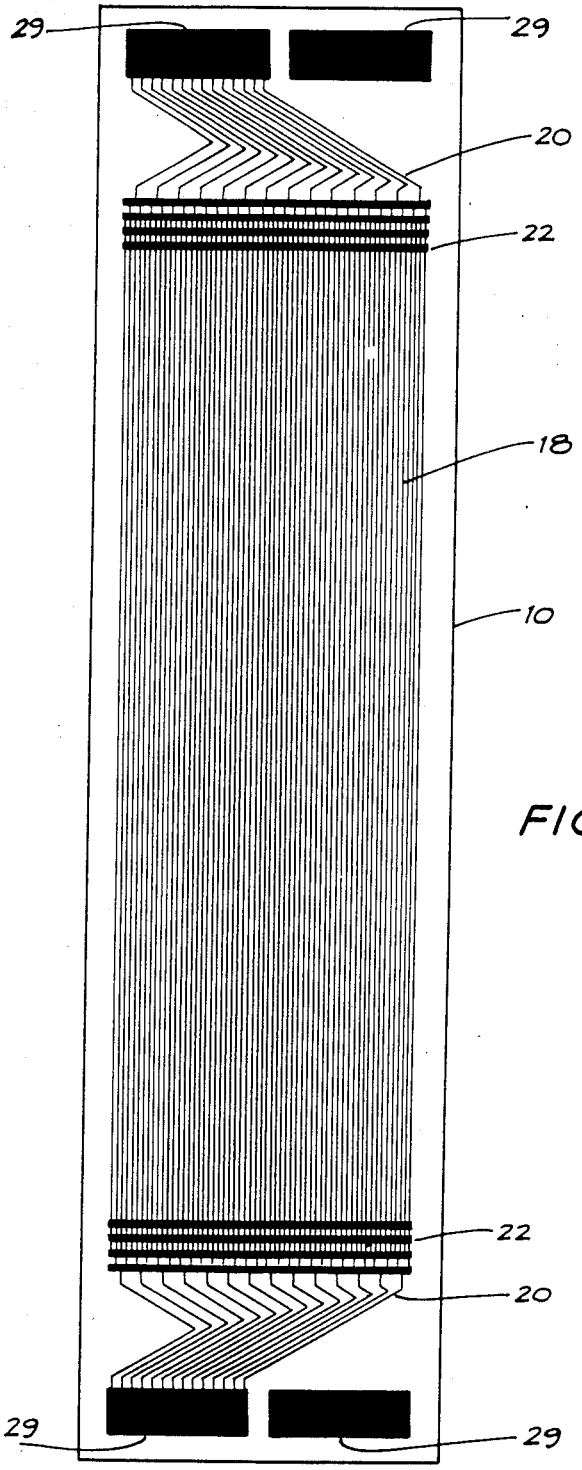
FIGS. 5 and 6 show representative examples of two different types of assymetrical plates for incorporation in the heat exchanger as shown in FIG. 1.
Figure 6:
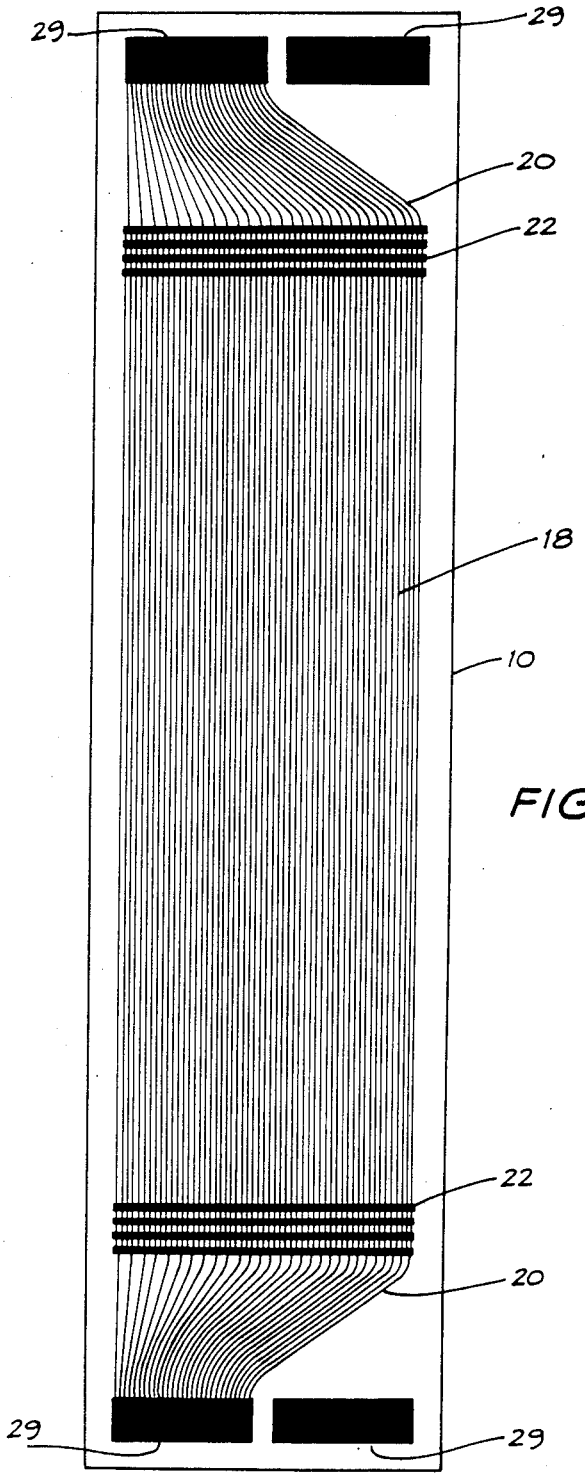

The plates 10 may be constructed in any one of a number of ways, for example, as shown in FIGS. 5 and 6, and the porting arrangement indicated in FIG. 1 will be varied in accordance with the location of ports in the plates actually employed.

Figure 2:
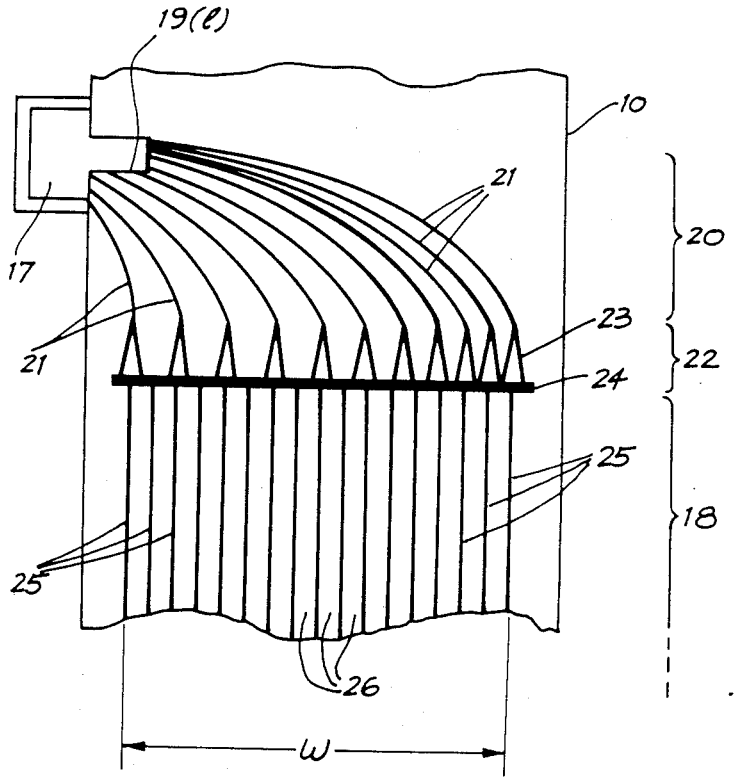
FIG. 2 is a schematic illustration of a portion of a plate for use in a heat exchanger of the type shown in FIG. 1.

FIG. 2 is a schematic representation of one face of a portion of a plate 10 for the heat exchanger of FIG. 1. Milled channels which form heat exchange, distribution and smoothing zone passages in the plate may be formed in one or both faces of the plate or be formed as slits and extend through the thickness of the plate. FIG. 2 shows a port 17 which is provided for delivering fluid to or receiving fluid from a heat exchange zone 18 in the plate 10. The port 17 may be located wholly within the periphery of the heat exchanger plates, at the periphery of the plates or (as shown) partly within and partly without the periphery of the plates.

The port 17 includes a so-called accessible edge 19 from which or to which fluid channels are connected. The accessible edge 19 would normally have a total length l less than the width w of the heat exchange zone 18, and the accessible edge 19 of the port may be disposed (partly or wholely) other than parallel to the upper marginal edge of the heat exchange zone 18. Consequently, fluid must be transferred from the port 17 to the heat exchange zone 18 by way of a distribution zone 20.

The distribution zone 20 is constituted by a series of distribution passages 21 which are formed from channels milled (e.g., by chemical milling) within the thickness of the plate 10. The passages all have a substantially identical and constant cross-sectional dimensions, and they extend between the accessible edge 19 of the port and a smoothing zone 22. The distribution passages 21 are closely spaced along the accessible edge 19 of the port, so as to maximise their number, and they preferably remain separate along their lengths. However, they may be cross-linked by further transverse passages (not shown) which intersect the distribution passages 21 at points of equal pressure.

The smoothing zone 22 is a region in which a component of the fluid flowing from the distribution zone is encouraged or permitted to flow in a transverse direction. This assists fluid passing between the distribution passages 21 and the heat exchange zone 18 to be fully dispersed across the full width of the heat exchange zone.

The passage pattern within the smoothing zone 22 need not differ from that in the heat exchange zone 18 if that pattern allows the desired transverse flow, but generally at least some transverse passages are provided to permit greater dispersal of the flow in less space. Where even fluid determination across the full width of the heat exchange zone is required, the various smooothing zone sections preferably are cross-linked and this provides a mechanism whereby the effects of minor flaws in distribution zone design or manufacture can be minimized by a small transverse flow of fluid.

Thus, the smoothing zone 22 comprises a plurality of passages 23 and 24 which are formed from channels milled within the thickness of the plate 10, and they are located at the junction of the distribution zone and the heat exchange zone and they connect these zones.

The heat exchange zone 18 is constituted by a passage arrangement which provides surface through which thermal contact with fluid streams in adjacent heat exchange zones may be established. The heat exchange zone 18 may comprise a single, broad, shallow passage within the thickness of one or more of the plates, but preferably it comprises a plurality of passages 25 interspersed with unremoved portions 26 of the original plate material which remain available for bonding and/or to support the proper shape of the passages. As illustrated, the heat exchange zone comprises a plurality of parallel passages 25 extending in a direction substantially perpendicular to the line of intersection of the smoothing zone 22 and the heat exchange zone 18.

The width of the heat exchange zone 18 served by each distribution passage 21 depends upon the impedance of flow offered by the distribution channel and the desired average low profile in the heat exchange zone. It is most commonly desired that an even flow be established across the full width of the heat exchange zone. Consequently, since the pressure along the accessible edge 19 of the port 17 will be substantially constant, substantially equal pressure drops along each of the distribution passages 21 is required.

The distribution zones 20 are generally arranged in one of two principal ways:

(1) In the first case, the distribution passages 21 have the same length and, preferably have the same number of bends and changes in flow direction. Substantially equal flows down such passages produce substantially equal pressure drops and, so, each passage delivers fluid to the same width of the heat exchange zone. This is so whether the flow is laminar, turbulent or transitional and is generally independent of where the principal sources of pressure drop occur. In some circumstances it might be found that the proximity of bends, for example, along the length of a passage has a bearing on the pressure drop, but for the most part such effects are not found to be important.

Two examples of the first type of distribution zone are shown in FIGS. 3*a* and 3*b*. In both, the distribution passages 21 are of the same length and have the same number of bends. As drawn, the bends are sharp, but they could be rounded to minimise the pressure drop they sustain. In both examples there is considerable variation in the distance between bends and some bends might effectively "disappear" during the drafting of the design or subsequent chemical etching. The soothing zone 22, with broad transverse passages, helps to eliminate the effect of such "imperfections".

The distribution zone shown in FIG. 3*a* is generally employed with a port 28 having an accessible edge 19 substantially parallel to the flow direction in the heat transfer zone 18. That of FIG. 3*b* is generally employed with a port 29 having an accessible edge 19 substantially perpendicular to the flow direction in the heat exchange zone 18.

(2) In the second case, the distribution passages 21 are of significantly different length. Since the pressure drop resulting from wall friction along the length of the passages is generally a significant, if not a predominant, proportion of the total pressure drop, such passages will generally carry different flow rates of fluid, when the total pressure drops along them are substantially identical. Therefore, even flow is produced by structuring the passages 21 so that the spacing between the passages decreases (at the heat exchange zone ends of the passages) with increasing length of the passages.

Examples of the second type of distribution zone are shown in FIGS. 2, 4*a* and 4*b*. The distribution passages 21 in FIGS. 2 and 4*a* are formed as elliptical arcs, while those in FIG. 4*b* are formed as circular arcs joined by tangents. These particular shapes are adopted for computational and drafting convenience, and an infinite variety of alternatives exists. The distribution zone shown in FIG. 4*a* is employed when an accessible edge 19 of the port 28 is predominantly parallel to the fluid flow in the heat transfer zone, and that of FIG. 4*b* when an accessible edge 19 of the port 29 is perpendicular to the fluid flow in the heat exchange zone.

The separate contributions of the pressure drops resulting from wall friction, bends and changes in flow cross-setion must be considered for each passage according to standard fluid mechanics techniques. Since pressure drops due to sharp bends and changes in flow cross-section cannot be reliably computed for all flow conditions, they are best avoided where possible, though changes in flow cross-section are generally unavoidable at the port and at the smoothing zone. In laminar flow, where the kinetic energy of the fluid is low, pressure losses resulting from changes in flow area are generally small compared with those due to wall friction. This is fortunate, as such pressure losses cannot be reliably computed for laminar flow. In turbulent flow, where these pressure drops assume greater significance, they are more reliably computed.

The pressure drop in each passage is given roughly by:

$$P_{drop}=(K_c+K_e+4f_{D_e}{}^{L})0.5\rho v^2$$

where $K_c$=contraction coefficient=0.6 (approx), Re>2000 (Re is Reynolds Number)

$K_e$=expansion coefficient=(1−area ratio)$^2$, Re>2000 (very approximate for 2000<Re<4000)

f=friction factor=0.01 (approx), Re>2000=16/Re, Re<2000

L=length of passage, m $D_e$=equivalent diameter of passage m, $\rho$=density of fluids, kg/m$^3$ v=velocity of fluid, m/s The considerable degree of approximation in determining the pressure drop in many cases emphasises the importance of the smoothing zone 22 in correcting deficiencies. The distributor passages greatly assist proper fluid distribution, rather than completely assure it.

In general, distribution zones of the first type (FIGS. 3*a* and 3*b*) distribute fluid more reliably and over a wide range of flow rates but sustain a higher pressure drop and/or occupy more space than those of the second type (FIGS. 2, 4*a* and 4*b*).

Figure 3:
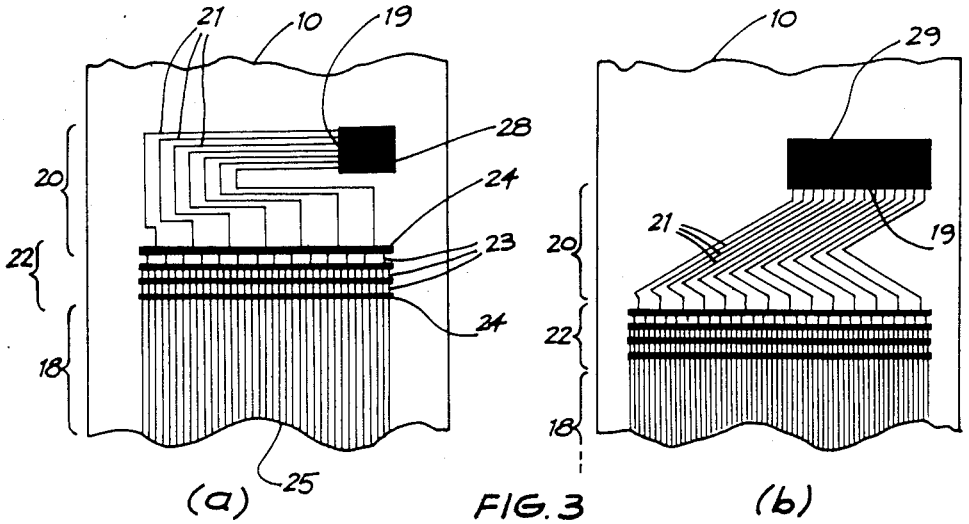
FIGS. 3A, 3B, 4A and 4B show partial views of four different plates for use in heat exchangers of the type shown in FIG. 1.
Figure 4:
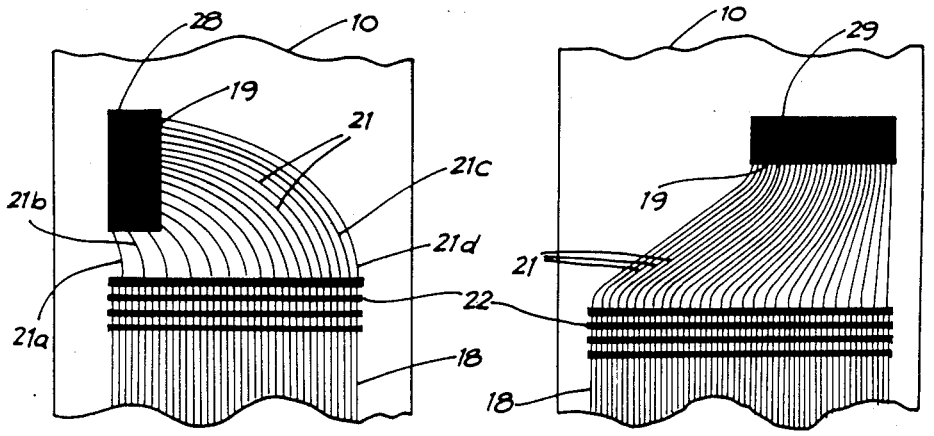

Examples of complete (assymetrical) plates 10 which incorporate the features of FIGS. 3 and 4 are shown in FIGS. 5 and 6 respectively.

Heat exchangers incorporating plates of the type described may be used for high effectiveness liquid/liquid contact, such as is required of the recuperative exchanger in the pasteurisation of liquid foodstuffs. Generally, long narrow plates are required in a heat exchanger to be used in such a duty and two pairs of ports 29 (17) are required for the inlets and outlets of the fluids.

When using plates as illustrated in FIG. 5 or FIG. 6 in a heat exchanger of the type shown in FIG. 1, the plates are formed such that the ports 29 penetrate the full thickness of the plates, but the channels which form the heat exchange, distribution and smoothing zones 18, 20 and 22 are milled into one surface only of each plate. All of the plates 10 in a given stack 9 would normally be identical (e.g., either as shown in FIG. 5 or in FIG. 6) but alternate ones of the plates 10*a* and 10*b* are inverted (i.e., rotated through 180° in the plane of the plate) so that, if the left hand ports in plate 10*a* are accessed by the distributor channels, the right hand ports in plate 10*b* will be accessed by the distributor channels.

It is possible to produce similar arrangements with a variety of alternative component plate designs. For example, two different plates designs, one being the mirror image of the other, might be employed so that fluids enter and leave through diagonally opposite ports. Alternatively, both sides of component plates may be channelled, with different fluids preferably contacting each side. Unchannelled partitioning plates may also be included to separate fluid passages when channels are formed on both sides of plates or by milling through the entire thickness of plates.

In FIG. 2 and the subsequent drawings, the channels 21 and 25 are shown to be narrow relative to the space between the channels. The channels are so shown for illustrative convenience only and, in most applications of the invention, the channels would have a width approximately three times that of the spacing between the channels.

What is claimed is:

1. A heat exchanger comprising a plurality of substantially flat plates stacked in face-to-face relationship and bonded together, at least some of the plates being formed within their respective thicknesses with longitudinally-extending channels which form heat-exchange zones through which fluid can be passed to exchange heat with fluid passing through similar channels in adjacent plates, at least some of the plates which are formed with a said heat-exchange zone being further formed with a first port communicating with one end of the heat-exchange zone, a second port communicating with the other end of the heat-exchange zone and, located between at least one of the ports and the associated end of the heat-exchange zone, a distribution zone and a smoothing zone; the smoothing zone comprising at least one transversely-extending fluid flow passage in which a transverse-flow component is imparted to fluid flowing between the distribution zone and the heat-exchange zone, and the distribution zone comprising a plurality of fluid-flow passages extending between an accessible edge of the port and the smoothing zone, the distribution zone passages spanning substantially the full width of the heat exchange zone, the distribution zone passages all being formed within the plate thickness, the passages all having equal cross-sectional dimensions and the passages all having the same length and being spaced apart from one another by an equal amount at the point of entry to the smoothing zone whereby substantially uniform flow of fluid will occur at all points across the width of the heat-exchange zone after the fluid has passed through the smoothing zone.

2. A heat exchanger as claimed in claim 1 wherein the smoothing zone comprises at least one transverse fluid-flow passage which extends between and links the heat-exchange zone channels adjacent the ends thereof.

3. A heat exchanger as claimed in claim 1 wherein each plate which incorporates a heat-exchange zone is formed with two distribution/smoothing zones, one of which being located between each port and the associated end of the heat exchange zone.

4. A heat exchanger as claimed in claim 1 wherein the heat-exchange zone channels, the distribution-zone passages and the smooothing-zone passages are formed as recesses in one face only of each said plate.

5. A heat exchanger as claimed in claim 1 wherein the channels and passages are formed in the plate by a chemical milling process.

6. A heat exchanger as claimed in claim 1 wherein the plates are diffusion bonded together.

7. A heat exchanger as claimed in claim 1 wherein the ports are formed wholely within the periphery of each plate.

8. A heat exchanger comprising a plurality of substantially flat plates stacked in face-to-face relationship and bonded together, at least some of the plates being formed within their respective thicknesses with longitudinally-extending channels which form heat-exchange zones through which fluid can be passed to exchange heat with fluid passing through similar channels in adjacent plates, at least some of the plates which are formed with a said heat-exchange zone being further formed with a first port communicating with one end of the heat-exchange zone, a second port communicating with the other end of the heat exchange zone and, located between at least one of the ports and the associated end of the heat-exchange zone, a distribution zone and a smoothing zone; the smoothing zone comprising at least one transversely extending fluid-flow passage in which a transverse-flow component is imparted to fluid flowing between the distribution zone and the heat-exchange zone, and the distribution zone comprising a plurality of fluid-flow passages extending between an accessible edge of the port and the smoothing zone, the distribution zone passages all being formed within the plate thickness and spanning substantially the full width of the heat-exchange zone, the passages all having equal cross-sectional dimensions and the pasages having different lengths with the spacing between the passages at the point of entry to the smoothing zone decreasing wtih increasing length of the passages, whereby substantially uniform flow of fluid will occur at all points across the width of the heat-exchange zone after the fluid has passed through the smoothing zone.

9. A heat exchanger as claimed in claim 8 wherein the smoothing zone comprises at least one transverse fluid-flow passage which extends between and links the heat-exchange zone channels adjacent the ends thereof.

10. A heat exchanger as claimed in claim 8 wherein each plate which incorporates a heat-exchange zone is formed with two distribution/smoothing zones, one of which being located between each port and the associated end of the heat-exchange zone.

11. A heat exchanger as claimed in claim 8 wherein the heat-exchange zone channels, the distribution-zone passages and the smoothing-zone passages are formed as recesses in one face only of each said plate.

12. A heat exchanger as claimed in claim 8 wherein the channels and passages are formed in the plate by a chemical milling process.

13. A heat exchanger as claimed in claim 8 wherein the plates are diffusion bonded together.

14. A heat exchanger as claimed in claim 8 wherein the ports are formed wholely within the periphery of each plate.

* * * * *